US011094266B2

(12) United States Patent
Heo et al.

(10) Patent No.: US 11,094,266 B2
(45) Date of Patent: Aug. 17, 2021

(54) DATA DRIVING CIRCUIT, DISPLAY PANEL AND DISPLAY DEVICE

(71) Applicant: LG DISPLAY CO., LTD., Seoul (KR)

(72) Inventors: SeongHoi Heo, Paju-si (KR); SuHyeon Jo, Paju-si (KR)

(73) Assignee: LG DISPLAY CO., LTD., Seoul (KR)

( * ) Notice: Subject to any disclaimer, the term of this patent is extended or adjusted under 35 U.S.C. 154(b) by 124 days.

(21) Appl. No.: 16/688,521

(22) Filed: Nov. 19, 2019

(65) Prior Publication Data

US 2020/0160795 A1 May 21, 2020

(30) Foreign Application Priority Data

Nov. 20, 2018 (KR) ..... 10-2018-0143465

(51) Int. Cl.
*G09G 3/3291* (2016.01)
*G09G 3/3258* (2016.01)

(52) U.S. Cl.
CPC ..... *G09G 3/3291* (2013.01); *G09G 3/3258* (2013.01); *G09G 2300/0819* (2013.01); *G09G 2320/0233* (2013.01); *G09G 2320/0247* (2013.01); *G09G 2330/021* (2013.01)

(58) Field of Classification Search
CPC .... G09G 1/146; G09G 3/3291; G09G 3/3258; G09G 2300/0819; G09G 2320/0233; G09G 2320/0247; G09G 2330/021
See application file for complete search history.

(56) References Cited

U.S. PATENT DOCUMENTS

| | | | | |
|---|---|---|---|---|
| 2012/0033000 | A1 | 2/2012 | Takahashi et al. | |
| 2017/0061875 | A1 | 3/2017 | Cho et al. | |
| 2018/0174512 | A1* | 6/2018 | Yuan | G09G 3/3233 |
| 2019/0019455 | A1 | 1/2019 | Chen | |
| 2019/0325822 | A1* | 10/2019 | Li | G09G 3/3266 |

FOREIGN PATENT DOCUMENTS

| | | | |
|---|---|---|---|
| CN | 102376244 | A | 3/2012 |
| CN | 107230452 | A | 10/2017 |
| CN | 108738201 | A | 11/2018 |

* cited by examiner

*Primary Examiner* — Alexander Eisen
*Assistant Examiner* — Nathaniel P Brittingham
(74) *Attorney, Agent, or Firm* — Birch, Stewart, Kolasch & Birch LLP

(57) ABSTRACT

The present disclosure relates to data driving circuits, display panels and display devices. In accordance with embodiments of the present disclosure, by periodically supplying a reset voltage to the subpixel SP in a holding interval of a period in which the display device is driven in a low-speed drive mode, it is possible to enable a waveform of luminance in a refresh interval to be identical to a waveform of luminance in the holding interval, and to prevent occurrence of flickers in the low-speed drive mode. In addition, by setting an optimal reset voltage in accordance with a driving voltage supplied to the display panel and changing the reset voltage for matching a changed driving voltage, it is possible to prevent flickers from being visible and to reduce power consumption through low-speed driving.

17 Claims, 16 Drawing Sheets

| VDD | 5 | 6 | 7 | 8 | 9 | 10 |
|---|---|---|---|---|---|---|
| $V_{rst}$ | 1 | 0.8 | 0.75 | 0.6 | 0.53 | 0.46 |

DATA DRIVING CIRCUIT, DISPLAY PANEL AND DISPLAY DEVICE

CROSS-REFERENCE TO RELATED APPLICATION

This application claims the priority benefit of Korean Patent Application No. 10-2018-0143465, filed on Nov. 20, 2018 in the Korean Intellectual Property Office, the disclosure of which is incorporated herein by reference in its entirety.

BACKGROUND

Field of the Disclosure

The present disclosure relates to data driving circuits, display panels and display devices.

Description of the Background Art

As the information-oriented society has been developed, various needs for display devices for displaying an image have increased. Recently, various types of display devices, such as Liquid Crystal Displays (LCD), Plasma Display Panels (PDP), and Organic Light Emitting Display (OLED) devices, have been developed and utilized.

In order to reduce power consumption, in a low power mode or a low-speed drive mode, such display devices can be driven at a frequency lower than a frequency for driving in a normal drive mode.

For example, after the display devices have been transitioned into an off-state, while the display devices are driven in an always on display (AoD) mode for displaying specific information (e.g., time, etc.) through an area of the display pane, the display devices can be driven with a lower frequency (e.g., 30 Hz, 24 Hz, etc.) than a drive frequency (e.g., 60 Hz) in the normal drive mode.

In this case, as one frame period becomes longer in the low-speed drive mode, a width at which luminance decreases for one frame period can increase. As a result, there occurs a problem that causes a flicker to be visible over the display panels as a difference in the luminance between frames increases.

SUMMARY

Accordingly, the present disclosure is directed to data driving circuits, display panels and display devices that substantially obviate one or more problems due to limitations and disadvantages of the background art.

Additional features and advantages of the disclosure will be set forth in the description which follows and in part will be apparent from the description, or can be learned by practice of the disclosure. The objects and other advantages of the disclosure will be realized and attained by the structure particularly pointed out in the written description and claims hereof as well as the appended drawings.

It is at least one object of the present disclosure to provide data driving circuits, display panels and display devices for preventing or minimizing occurrence of flickers over display panels when the panels are driven in a low-speed drive mode.

It is further at least one object of the present disclosure to provide data driving circuits, display panels and display devices for preventing or minimizing occurrence of flickers over display panels, by changing a driving voltage supplied to the display panel according to driving states thereof, when the display panel is driven in the low-speed drive mode.

In accordance with an aspect of the present disclosure, a display device is provided that includes a display panel including a plurality of gate lines, a plurality of data lines and a plurality of subpixels, a gate driving circuit driving the plurality of gate lines, and a date driving circuit driving the plurality of data lines.

Each of the plurality of subpixels included in the display device can include a light emitting element, a driving transistor including a first node driving the light emitting element and electrically connected to a driving voltage line, a second node that is a gate node, and a third node electrically connected to the light emitting element, and a scan transistor electrically connected between the third node and at least one of the plurality of data lines.

In addition, a data voltage is applied to the at least one data line in a first interval, and a reset voltage is applied at least once to the at least one data line in a second interval, of a frame period in the low-speed drive mode. When a first level of the driving voltage is applied to the driving voltage line, a level of the reset voltage applied to the at least one data line can be different from a level of the reset voltage applied to the at least one data line when a second level of the driving voltage different from the first level of the driving voltage is applied to the driving voltage line.

In accordance with another aspect of the present disclosure, a display panel is provided that includes a light-emitting element, a driving transistor driving the light-emitting element, and including a first node electrically connected to a driving voltage line, a second node that is a gate node, and a third node electrically connected to the light-emitting element, and a scan transistor electrically connected between the third node and a data line. A data voltage is applied to the data line in a first interval, and a reset voltage is applied at least once to the data line in a second interval, of a frame period in the low-speed drive mode. When a first level of the driving voltage is applied to the driving voltage line, a first level of the reset voltage applied to the data line is different from a second level of the reset voltage applied to the data line when a second level of the driving voltage different from the first level of the driving voltage is applied to the driving voltage line.

In accordance with further another aspect of the present disclosure, a data driving circuit is provided that includes: a voltage output unit outputting a driving voltage to a driving voltage line, a data voltage output unit outputting a data voltage to a data line in a first interval of a frame period, and a reset voltage output unit periodically outputting at least once a reset voltage to the data line in a second interval after the first interval of the frame period in the low-speed drive mode.

At this time, when the driving voltage output unit outputs a first level of the driving voltage to the driving voltage line, a level of the reset voltage which the reset voltage output unit outputs to the data line is different from a level of the reset voltage which the reset voltage output unit outputs to the data line when the driving voltage output unit outputs a second level of the driving voltage different from the first level of the driving voltage to the driving voltage line.

In accordance with embodiments of the present disclosure, by periodically supplying a reset voltage in a holding interval after a refresh interval when the display device or the display panel is driven in the low-speed drive mode, it is possible to enable a waveform of luminance in the holding interval to be identical or substantially identical to a waveform of luminance in the refresh interval.

Accordingly, it is possible to prevent or minimize cause or occurrence of flickers during a period in which the display device or the display panel is driven in the low-speed drive mode, and to maintain display quality of images and reduce power consumption.

In addition, by changing a reset voltage in accordance with a level of a driving voltage supplied to the display panel, it is possible to prevent occurrence of flickers when the driving voltage is changed according to a driving state of the display device.

DETAILED DESCRIPTION OF THE EMBODIMENTS

Figure 1:
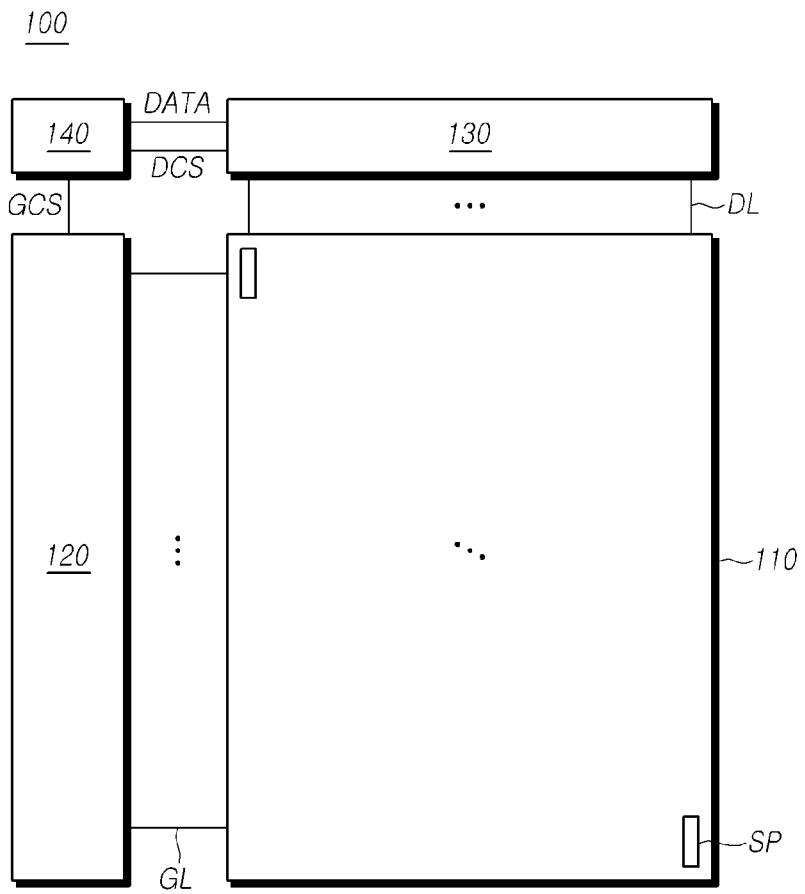
FIG. 1 is a block diagram illustrating a display device according to embodiments of the present disclosure.

Hereinafter, the present preferred embodiments of the disclosure will be described in detail with reference to the accompanying drawings. In denoting elements of the drawings by reference numerals, the same elements will be referenced by the same reference numerals although the elements are illustrated in different drawings. In the following description of the disclosure, detailed description of known functions and configurations incorporated herein can be omitted when it can make the subject matter of the disclosure rather unclear.

Terms, such as first, second, A, B, (a), or (b) can be used herein to describe elements of the disclosure. Each of the terms is not used to define essence, order, sequence, or number of an element, but is used merely to distinguish the corresponding element from another element. When it is mentioned that an element is "connected" or "coupled" to another element, it should be interpreted that another element can be "interposed" between the elements or the elements can be "connected" or "coupled" to each other via another element as well as that one element is directly connected or coupled to another element.

FIG. 1 is a block diagram illustrating a display device 100 according to embodiments of the present disclosure. All components of the display device according to all embodiments of the present disclosure are operatively coupled and configured.

Referring to FIG. 1, the display device according to embodiments of the present disclosure 100 can include a display panel 110 including a plurality of subpixels SP, a gate driving circuit 120, a data driving circuit 130 and a controller 140, for driving the display panel 110.

A plurality of data lines DL and a plurality of gate lines GL are arranged in the display panel 110, and the plurality of subpixel SP is arranged in an area defined by the data lines DL and the gate lines GL.

The gate driving circuit 120 is controlled by the controller 140, and sequentially outputs scan signals to the plurality of gate lines GL arranged in the display panel 110 for controlling driving timings of the subpixels.

The gate driving circuit 120 can output a scan signal for controlling a driving timing of at least one of the subpixels, and a light-emitting signal for controlling a light-emitting timing of at least one of the subpixels. In this case, a circuit for outputting the scan signal and a circuit for outputting the light-emitting signal can be implemented separately from each other, or implemented in one circuit together.

The gate driving circuit 120 can include one or more gate driver integrated circuits GDIC. The gate driving circuit 120 can be located on one side or both sides of the display panel 110, such as, a left or right side, a top or bottom side, the left and right sides, or the top and bottom sides, according to a driving scheme.

Each gate driver integrated circuit GDIC can be connected to a pad, such as a bonding pad, of the display panel 110 in a tape automated bonding (TAB) type or a chip on glass (COG) type, or be directly disposed on the display panel 110 in a gate in panel (GIP) type. In some instances, the gate driver integrated circuit GDIC can be disposed to be integrated into the display panel 110. Each gate driver integrated circuit GDIC can be implemented in a chip on film (COF) type, which is mounted on a film connected to the display panel 110.

The data driving circuit 130 receives image data from the controller 140 and then converts the received image data into analog data voltages. The data driving circuit 130 outputs a data voltage to each data line DL by matching a timing at which the scan signal is applied through the gate line GL, and enables each subpixel SP to emit a color in accordance with the image data.

The data driving circuit 130 can include one or more source driver integrated circuits SDIC.

Each source driver integrated circuit SDIC can include a shift register, a latch circuit, a digital to analog converter DAC, an output buffer, or the like.

Each source driver integrated circuit SDIC can be connected to a pad, such as a bonding pad, of the display panel 110 in the tape automated bonding (TAB) type or the chip on glass (COG) type, or be directly disposed on the display panel 110. In some instances, the source driver integrated circuit SDIC can be disposed to be integrated into the display panel 110. Each source driver integrated circuit SDIC can be implemented in a chip on film (COF) type. In this case, the source driver integrated circuit SDIC can be mounted on a film connected to the display panel 110, and be electrically connected to the display panel 110 through lines on the film.

The controller 140 provides several control signals to the gate driving circuit 120 and the data driving circuit 130, and controls operations of the gate driving circuit 120 and the data driving circuit 130.

The controller 140 can be mounted on a printed circuit board (PCB), a flexible printed circuit (FPC), etc. and be electrically connected to the gate driving circuit 120 and the data driving circuit 130 through the printed circuit board (PCB), flexible printed circuit (FPC), etc.

The controller 130 enables the gate driving circuit 120 to output a scan signal according to a timing processed in each frame, converts image data input from external devices or image providing sources to a data signal form used in the data driving circuit 130, and then outputs image data resulted from the converting to the data driving circuit 13.

The controller 140 receives, along with the image data, several types of timing signal including a vertical synchronous signal Vsync, a horizontal synchronous signal Hsync, an input data enable DE signal, a clock signal CLK, etc. from other devices, networks, or systems (e.g., a host system).

The controller 140 can generate several types of control signal using the received timing signals, and output the generated signals to the gate driving circuit 120 and the data driving circuit 130.

For example, to control the gate driving circuit 120, the controller 140 outputs several types of gate control signal GCS including a gate start pulse GSP, a gate shift clock GSC, a gate output enable signal GOE, and the like.

Here, the gate start pulse GSP is used for controlling a start timing for operating one or more gate driver integrated circuits GDIC constituting the gate driving circuit 120. The gate shift clock GSC is a clock signal commonly inputted to one or more gate driver integrated circuits GDIC, and is used for controlling a shift timing of a scan signal. The gate output enable signal GOE is used for indicating timing information of one or more gate driver integrated circuits GDIC.

In addition, to control the data driving circuit 130, the controller 140 outputs several types of data control signal DCS including a source start pulse SSP, a source sampling clock SSC, a source output enable signal SOE, and the like.

Here, the source start pulse SSP is used for controlling a data sampling start timing of one or more source driver integrated circuits SDIC constituting the data driving circuit 130. The source sampling clock SSC is a clock signal for controlling a sampling timing of data in each source driving integrated circuit SDIC. The source output enable signal SOE is used for controlling an output timing of the data driving circuit 130.

The display device 100 can supply several types of voltage or current to the display panel 110, the gate driving circuit 120, and the data driving circuit 130 etc., or can further include a power management integrated circuit (not shown) for controlling the several types of voltage or current to be supplied.

Each subpixel SP is disposed in an area defined by intersecting of each of the gate lines GL and each of the data lines DL. According to types of display device 100, a liquid crystal composition or a light-emitting element can be disposed in the subpixel SP.

Figure 2:
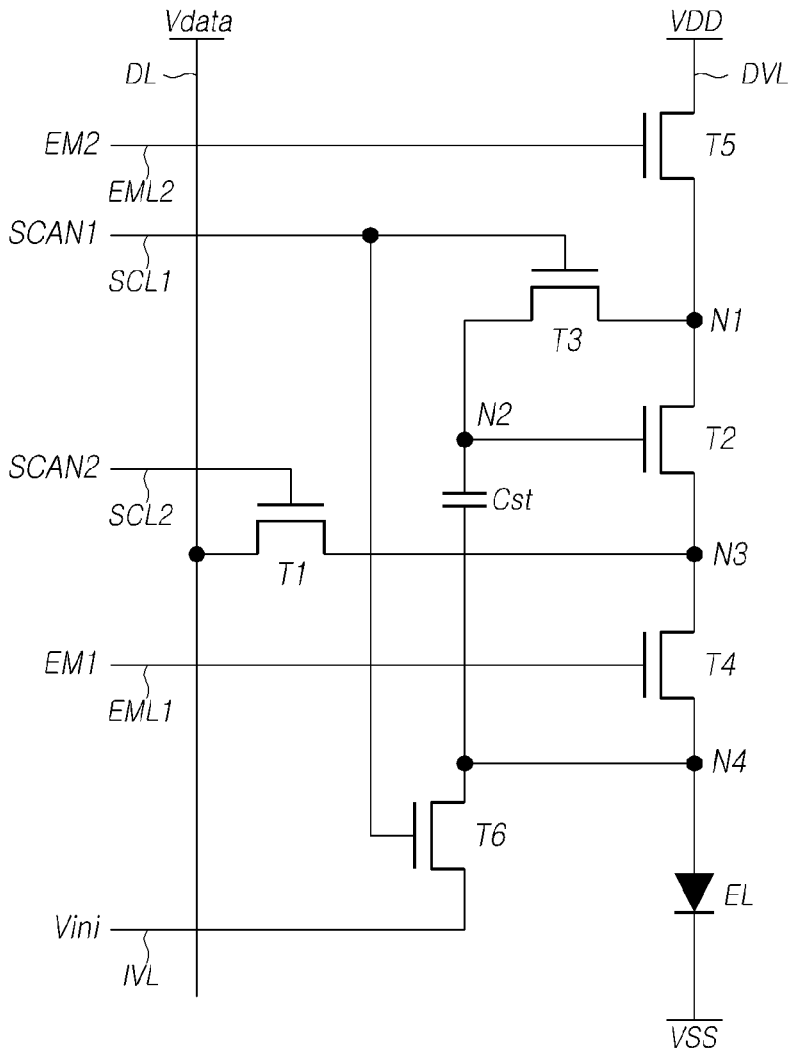
FIG. 2 is a schematic circuit diagram of a subpixel disposed in the display device according to embodiments of the present disclosure.

FIG. 2 is a schematic circuit diagram of a subpixel disposed in the display device according to embodiments of the present disclosure.

Referring to FIG. 2, the subpixel of the display device 100 according to embodiments of the present disclosure can include, e.g., a light-emitting element EL, a plurality of transistors T1 to T6 for driving the light-emitting element EL, and at least one capacitor Cst.

For example, FIG. 2 shows an example subpixel configured with six transistors and one capacitor (6T-1C); however, embodiments of the present disclosure are not limited thereto. Circuit elements disposed in the subpixel can be implemented in various designs according to types of display device.

In addition, FIG. 2 shows that n-type transistors are disposed in the subpixel SP, but in some instances, p-type transistors can be disposed in the subpixel.

In case the subpixel SP is configured with the 6T-1C structure, the 6 transistors T1 to T6 and the 1 capacitor Cst can be disposed in each subpixel SP.

A first transistor T1 is controlled by a second scan signal SCAN2 supplied through a second scan line SCL2, and can be electrically connected between a data line DL to which a data voltage is applied and a third node N3. Such a first transistor T1 can be referred to as a scan transistor.

A second transistor T2 can have a first node N1, and a second node N2 and the third node N3. The first node N1 can be a drain node or a source node, and be electrically connected to a driving voltage line DVL to which a driving voltage VDD is applied. The second node N2 can be a gate node. The third node N3 can be the source node or the drain node, and be electrically connected to an anode electrode of the light-emitting element EL. Such a second transistor T2 can be referred to as a driving transistor.

A third transistor T3 is controlled by a first scan signal SCAN1 supplied through a first scan line SCL1, and can be electrically connected between the first node N1 and the second node N2 of the second transistor T2. Such a third transistor T3 can be referred to as a compensation transistor.

A fourth transistor T4 is controlled by a first light-emitting signal EM1 supplied through a first light-emitting control line EML1, and can be electrically connected between the third node N3 and a fourth node N4. Such a fourth transistor T4 can be referred to as a first light-emitting transistor.

A fifth transistor T5 is controlled by a second light-emitting signal EM2 supplied through a second light-emitting control line EML2, and can be electrically connected between the first node N1 and the driving voltage line DVL. Such a fifth transistor T5 can be referred to as a second light-emitting transistor.

A sixth transistor T6 is controlled by the first scan signal SCAN1 supplied through the first scan line SCL1, and can be electrically connected between the fourth node N4 and an initialization voltage line IVL. Such a sixth transistor T6 can be referred to as an initialization transistor.

A capacitor Cst is connected between the second node N2 and the fourth node N4, and can maintain a data voltage Vdata for a time period of one frame.

The light-emitting element EL is electrically connected between the fourth node N4 and a line to which a low voltage VSS is applied. The light-emitting element EL can be, e.g., an organic light emitting diode OLED, etc.

Figure 3:
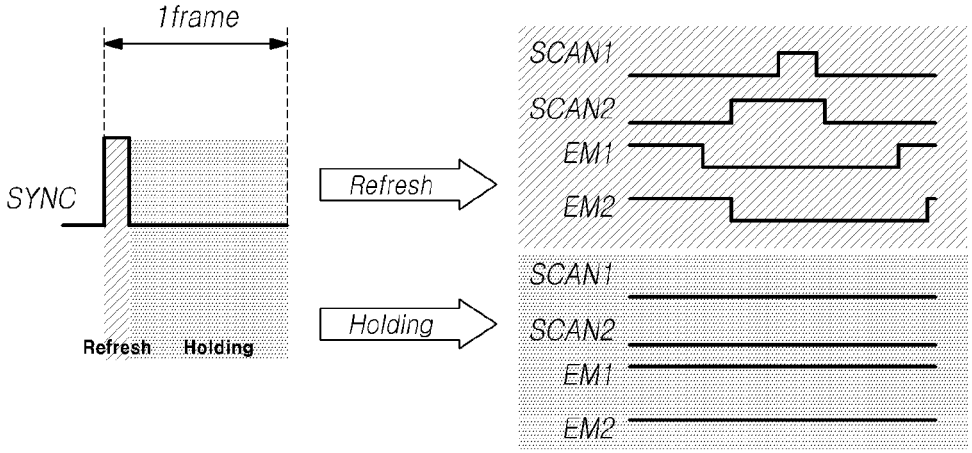
FIG. 3 is a timing chart for driving the subpixel shown in FIG. 2.

FIG. 3 shows a timing chart for driving the subpixel shown in FIG. 2 according to embodiments of the present disclosure.

Referring to FIG. 3, one frame period can be divided into a refresh interval (or a first interval) and a holding interval (or a second interval), which are in sync with a synchronization signal SYNC.

A data voltage Vdata and an initialization voltage Vini for driving the subpixel SP can be applied to the subpixel SP in the refresh interval.

Specifically, in the refresh interval, in a state where the first light-emitting signal EM1 and the second light-emitting signal EM2 are applied with a low level, the first scan signal SCAN1 and the second scan signal SCAN2 can be applied with a high level.

Since the first light-emitting signal EM1 and the second light-emitting signal EM2 are applied with the low level, the fourth transistor T4 and the fifth transistor T5 is turned off.

Since the first scan signal SCAN1 is applied with the high level, the third transistor T3 and the sixth transistor T6 become turned on. Since the second scan signal SCAN2 is applied with the high level, the first transistor T1 becomes turned on.

Here, a case where the second scan signal SCAN2 is applied with the high level at an earlier time than the first scan signal SCAN1 is discussed, but in some instances, the first scan signal SCAN1 can be applied with the high level at an earlier time than the second scan signal SCAN2.

Since the first transistor T1 is turned on, a data voltage Vdata can be applied to the third node N3. Since the third transistor T3 is turned on, the data voltage Vdata applied to the third node N3 is applied to the second node N2 through the first node N1.

At this time, a voltage obtained by subtracting a threshold value of the second transistor T2 from the data voltage Vdata can be applied to the second node N2, and thus, it is possible to compensate the threshold voltage of the second transistor T2.

In addition, since the initialization voltage Vini is applied to the fourth node N4 by the turn-on of the sixth transistor T6, thus the data voltage Vdata and the initialization voltage Vini become applied to both ends of the capacitor Cst.

In the holding interval after the refresh interval, the light-emitting element can emit light according to data voltages Vdata applied to the subpixel SP.

Specifically, in the holding interval, the first scan signal SCAN1 and the second scan signal SCAN2 can be applied with a low level, and the first light-emitting signal EM1 and the second light-emitting signal EM2 can be applied to with a high level.

Since the first scan signal SCAN1 and the second scan signal SCAN2 are applied with the low level, the fourth transistor T3 and the fifth transistor T6 become turned off.

Since the first light-emitting signal EM1 and the second light-emitting signal EM2 are applied with the high level, the fourth transistor T4 and the fifth transistor T5 become turned on.

Here, since the data voltage Vdata has been applied to the second node N2 which is the gate node of the second transistor T2, the light-emitting element EL can be driven by a current flowing through the second transistor T2 and corresponding to the data voltage Vdata, and represent brightness in accordance with the data voltage Vdata.

For example, the initialization and the application of the data voltage Vdata can be performed in the refresh interval of one frame period, and light-emitting of the light-emitting element can be performed in the holding interval of one frame period.

At this time, a length of the holding interval of one frame period can be larger when the display device 100 is driven in the low-speed drive mode to reduce power consumption. Further, a width corresponding to a degree to which the luminance of the subpixel SP decreases for one frame period can become larger, as the holding interval becomes larger.

Figure 4:
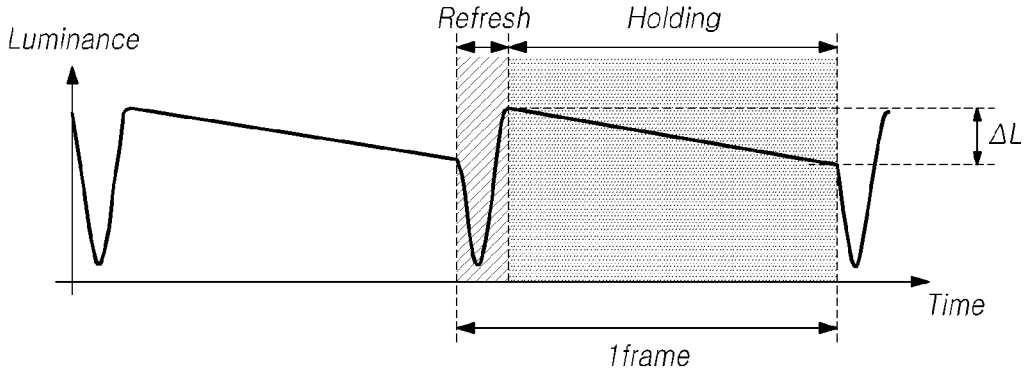
FIG. 4 is a plot showing a variance in luminance representing in the low-speed drive mode when the subpixel is driven according to the timing shown in FIG. 3.

FIG. 4 is a plot showing a variance in luminance that represents in the low-speed drive mode when the subpixel is driven according to the timing shown in FIG. 3.

Referring to FIG. 4, in the refresh interval, the luminance of the subpixel SP can be instantaneously lowered because the data voltage Vdata and the initialization voltage Vini are applied in the state where the fourth transistor T4 and the fifth transistor T5 is turned off.

Further, the light-emitting element starts light-emitting, when the initialization and the application of the data voltage Vdata have been performed, and the fourth transistor T4 and the fifth transistor T5 become turned on, and therefore luminescence of the subpixel SP can increase.

Thereafter, in the holding interval, the luminescence of the subpixel SP can gradually decrease, and when the subpixel SP is driven in the low-speed drive mode, a width ΔL corresponding to a degree to which the luminance of the subpixel SP is decreased for the holding interval can become larger because a length of the holding interval becomes larger.

Accordingly, when the subpixel SP is driven in the low-speed drive mode, a difference in luminance between frames increases, and therefore there is a problem that a flicker can be recognized due to the difference in luminance.

In accordance with embodiments of the present disclosure, when the display device 100 is driven in the low-speed drive mode, it is possible to prevent flickers from being visible over the display panel 110 by periodically supplying a specific voltage to the subpixel SP in the holding interval.

Figure 5:
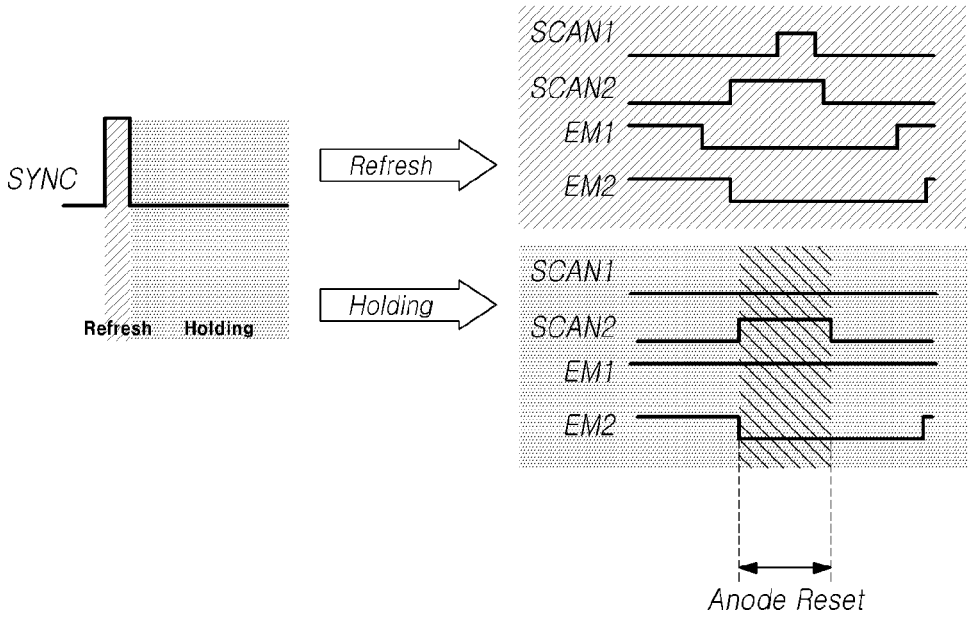
FIG. 5 is a timing chart of another example for driving the subpixel shown in FIG. 2.

FIG. 5 shows another example of driving timing of the subpixel shown in FIG. 2.

Referring to FIG. 5, one frame period can be divided into a refresh interval and a holding interval in sync with a synchronization signal SYNC, and in the refresh interval, a data voltage Vdata and an initialization voltage Vini can be applied to the subpixel SP for driving the subpixel SP.

A driving scheme in the refresh interval can be similar or identical to the driving scheme in the refresh interval discussed through FIG. 3.

Further, in the holding interval, a first scan signal SCAN1 and a second scan signal SCAN2 can be applied with a low level to the subpixel SP, and a first light-emitting signal EM1 and a second light-emitting signal EM2 can be applied with a high level to the subpixel SP. Accordingly, a light-emitting element disposed in the subpixel SP can emit light.

At this time, a reset voltage Vrst can be periodically applied for resetting an anode electrode of the light-emitting element EL through a data line DL for the holding interval.

Specifically, in the holding interval, the second scan signal SCAN2 is applied with a high level, and the second light-emitting signal EM2 is applied with a low level, for an interval in which the anode electrode of the light-emitting element EL is reset.

For example, levels of the second scan signal SCAN2 and the second light-emitting signal EM2 can be changed in a state where the first scan signal remains with the low level and the first light-emitting signal remains with the high level.

In addition, in an interval where the second scan signal SCAN2 is applied with the high level, the reset voltage Vrst can be applied to the subpixel through the data line DL.

The first transistor T1 and the fourth transistor T4 become turned on because the second scan signal SCAN2 and the first light-emitting signal EM1 are applied with the high level.

Accordingly, the reset voltage Vrst supplied through the data line DL can be applied to the fourth node N4, i.e., the anode electrode of the light-emitting element EL, through the first transistor T1 and the fourth transistor T4.

In addition, the reset voltage is applied to the anode electrode of the light-emitting element EL for the holding interval, and therefore, the brightness of the light-emitting element EL can vary depending on the reset voltage Vrst.

Here, the reset voltage Vrst is a voltage for preventing cause or occurrence of a flicker in the low-speed drive mode, and can be therefore a voltage for enabling the luminance of the light-emitting element EL to match a level of luminance representing in the refresh interval.

In addition, the reset voltage Vrst can be supplied once every interval identical to the refresh interval for the holding interval.

For example, by enabling a waveform of luminance representing in the refresh interval to represent repeatedly in the holding interval, it is possible to prevent cause or occurrence of a flicker on the display due to a decrease in luminance in the holding interval in the low-speed drive mode.

Figure 6:
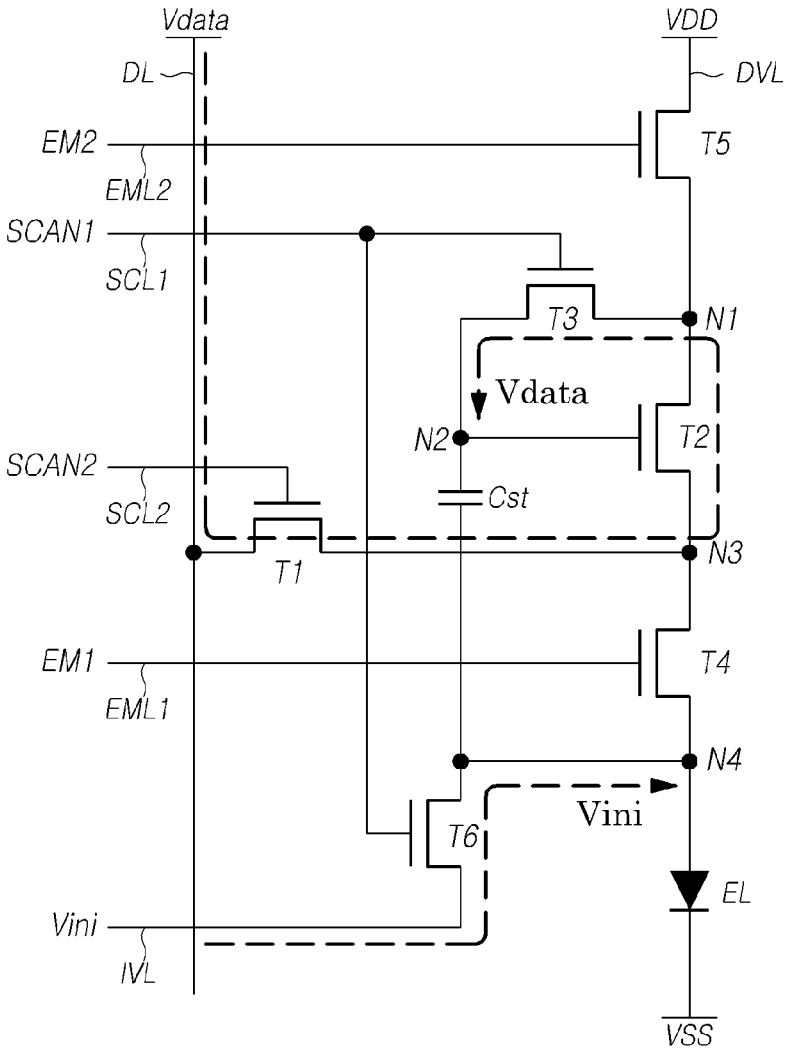
FIGS. 6 to 8 are diagrams illustrating a process of driving the subpixel according to the timing shown in FIG. 5.
Figure 6:
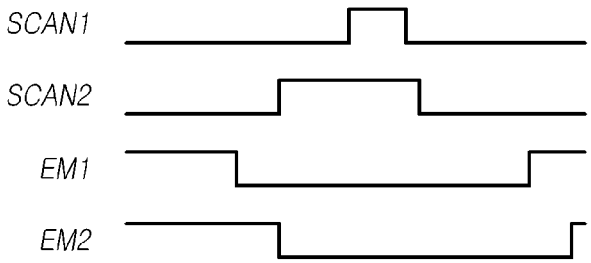
Figure 7:
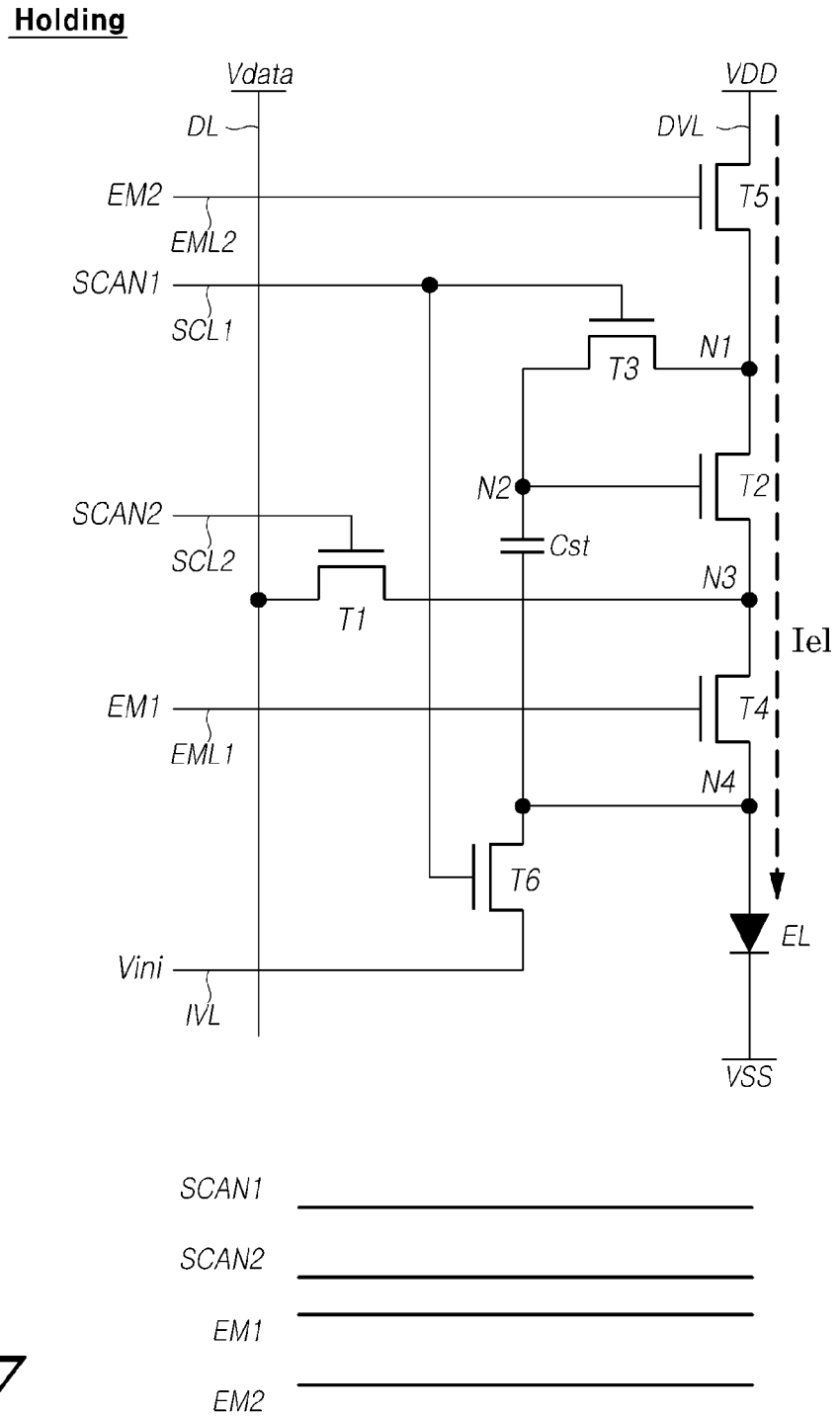
Figure 8:
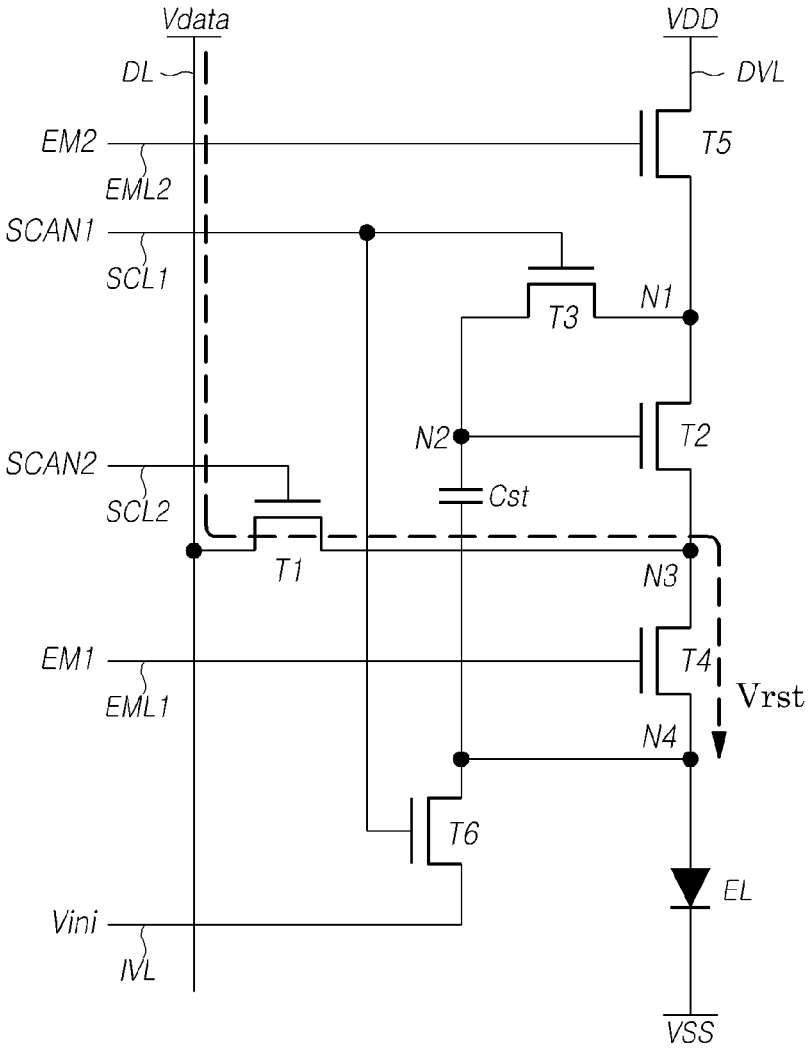
Figure 8:
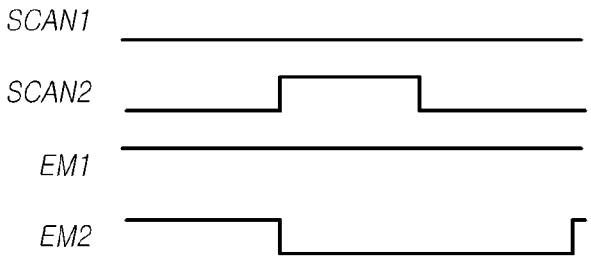

FIGS. 6 to 8 are diagrams illustrating a process of driving the subpixel according to the timing shown in FIG. 5.

More specifically, FIG. 6 shows that the subpixel SP is driven in the refresh interval in the low-speed drive mode of the display device 100.

In the refresh interval, the first scan signal SCAN1 and the second scan signal SCAN2 are applied with a high level in a state where the first light-emitting signal EM1 and the second light-emitting signal EM2 are in a low level.

In addition, in an interval where the first scan signal SCAN1 is applied with the high level, a data voltage Vdata can be supplied through the data line DL.

Accordingly, the data voltage Vdata supplied through the data line DL can be applied to the gate node, i.e., the second node N2, of the second transistor T2 that is the driving transistor.

At this time, the data voltage Vdata supplied through the data line DL can be applied to the second node N2 through the second transistor T2. Accordingly, a voltage obtained by subtracting a threshold voltage of the second transistor T2 from the data voltage Vdata can be applied to the second node N2, and thus, it is possible to compensate the threshold voltage of the second transistor T2.

In addition, an initialization voltage Vini is applied to the fourth node N4, and thus the initialization and the application of the data voltage Vdata are performed for the refresh interval.

Referring to FIG. 7, in the holding interval, the first scan signal SCAN1 and the second scan signal SCAN2 are applied with a low level, and the first light-emitting signal EM1 and the second light-emitting signal EM2 are applied with a high level.

Accordingly, the fourth T4 and the fifth transistor T5 become turned on in a state where the first transistor T1, the third transistor T3 and the sixth transistor T6 are turned off.

Further, since the data voltage Vdata has been applied to the gate node N2 of the second transistor T2, and the initialization voltage Vini has been applied to the fourth N4, a current Iel corresponding to the data voltage Vdata flows through the second transistor T2, and thus the light-emitting element EL starts to emit light.

Referring to FIG. 8, in the holding interval, in a stage where the first scan signal SCAN1 remains in the low level and the first light-emitting signal EM1 remains in the high level, the second scan signal SCAN2 can be repeatedly applied with a high level and the second light-emitting signal EM2 can be applied with a low level.

In addition, in an interval where the second scan signal SCAN2 is applied with the high level, a reset voltage Vrst can be applied through the data line DL.

The first transistor T1 and the fourth transistor T4 is turned on due to the second scan signal SCAN2 and the first light-emitting signal EM1, and therefore, the reset voltage supplied through the data line DL is applied to the fourth node N4, i.e., the anode electrode of the light-emitting element EL.

Accordingly, a level of luminance of the light-emitting element EL in the holding interval can vary, as the reset voltage Vrst is applied. In addition, as the level of luminance varies, a waveform of luminance of the light-emitting element can be identical or substantially identical to a waveform of luminance representing in the refresh interval, and as a result, it is possible to prevent flickers from occurring and being visible in the holding interval in the low-speed drive mode.

Figure 9:
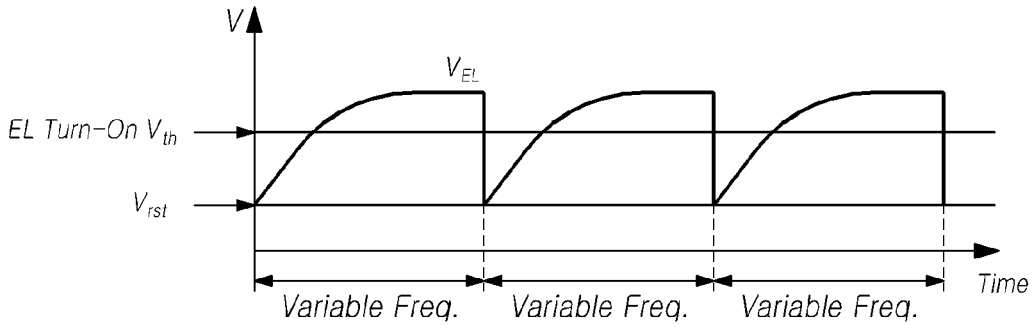
FIG. 9 is a plot showing a reset voltage which is supplied to the subpixel while the subpixel is driven according to the timing shown in FIG. 5.

FIG. 9 is a plot showing a reset voltage supplied to the subpixel SP while the subpixel is driven according to the timing shown in FIG. 5.

Referring to FIG. 9, the reset voltage supplied to the subpixel SP in the holding interval in the low-speed drive mode can be lower than a threshold voltage of the light-emitting element EL disposed in the subpixel SP.

In addition, such a reset voltage Vrst can be periodically supplied for the holding interval in the low-speed drive mode. For example, the reset voltage can be supplied every interval identical to the refresh interval.

When the display device or the display panel is driven in the low-speed drive mode, the reset voltage Vrst can be periodically applied for the holding interval, and therefore, a voltage $V_{EL}$ of the anode electrode of the light-emitting element EL can be periodically lower than a threshold voltage of the light-emitting EL.

Accordingly, a waveform of luminance representing in the holding interval in the low-speed drive mode can be similar or substantially identical to a waveform of luminance representing in the refresh interval, and as a result, it is possible to prevent flickers from occurring on the display panel 110.

Meanwhile, the reset voltage Vrst supplied for preventing or overcoming such a flicker can be fixed, or be changed according to driving conditions, or states etc. of the display device 100.

For example, such a reset voltage Vrst can be supplied to the display panel 110 after having been changed according to a driving voltage VDD supplied to the display panel 110.

Figure 10:
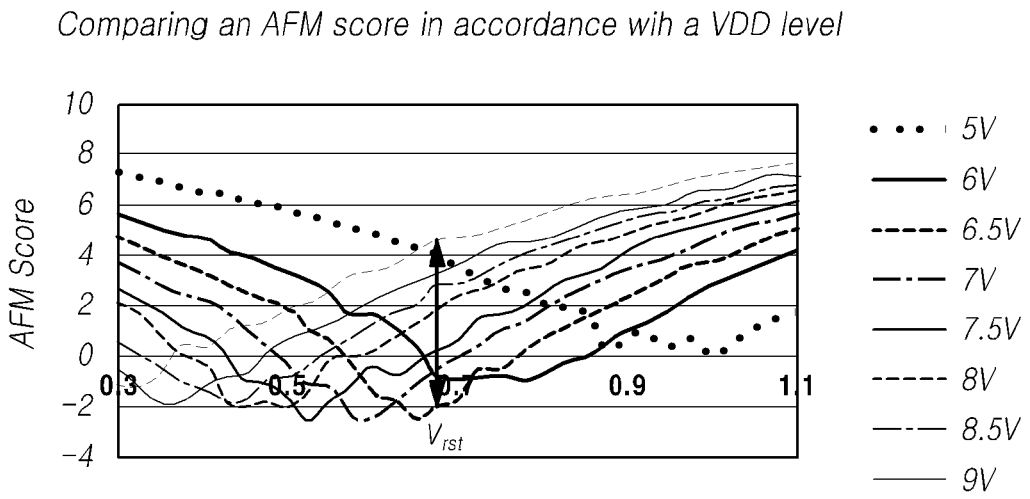
FIG. 10 is a graph showing a flicker score in accordance with a driving voltage and a reset voltage while the subpixel is driven according to the timing shown in FIG. 5.

FIG. 10 is a graph showing a flicker score in accordance with a driving voltage and a reset voltage while the subpixel is driven according to the timing shown in FIG. 5.

Particularly, FIG. 10 represents flicker scores in accordance with reset voltages Vrst supplied in the holding interval in the low-speed drive mode, when a driving voltage VDD supplied to the display panel 110 varies in a range of 5V to 9V.

Here, the flicker score, i.e., the AFM score, shown in FIG. 10 denotes an index in accordance with a difference in waveforms of luminance between the refresh interval and the holding interval, when the display device 100 is driven in a specific frequency (e.g., 1 Hz etc.).

For example, when a specific level of driving voltage VDD and a specific level of reset voltage Vrst are supplied to the display device 100 driven with a specific frequency, the AFM score represents, as an index, a difference in waveforms of luminance between a waveform of luminance representing in the refresh interval and a waveform of luminance representing in the holding interval.

In addition, when such a flicker score is less than and equal to 0, it can be considered that a flicker is not recognized.

At this time, for example, in case a driving voltage VDD supplied to the display panel 110 is 5V, the flicker score is lowest when a reset voltage Vrst is about 1.0V. As another example, in case the driving voltage VDD supplied to the display panel 110 is 9V, the flicker score is lowest when the reset voltage Vrst is about 0.35V.

Accordingly, it can be seen that a reset voltage Vrst corresponding to a flicker score in which a flicker is not recognized differs depending on a level of the driving voltage VDD.

For example, in case a reset voltage Vrst supplied in the holding interval in the low-speed drive mode is fixed at a specific voltage, e.g., about 0.69 V, a flicker may not be recognized in a specific range (e.g., 6V to 7V) of the driving voltage VDD, but it can be recognized in another range (e.g., 8V to 9V) of the driving voltage VDD.

In accordance with embodiments of the present disclosure, in case the display device 100 or the display panel is driven in the low-speed drive mode, even when the driving voltage VDD supplied to the display panel 110 varies in the low-speed drive mode, it is possible to prevent occurrence of flickers, by allowing a reset voltage Vrst supplied in the holding interval to be changed according to a level of the driving voltage VDD.

For example, a reset voltage can be set according to each driving voltage VDD based on the flicker index described above.

For example, while the display device 100 is driven with a specific frequency, such as 1 Hz, a flicker score in accordance with a difference in waveforms of luminance between the refresh interval and the holding interval can be measured by changing a level of the driving voltage VDD and a level of the reset voltage Vrst.

Further, a reset voltage Vrst for enabling the flicker score to become less than and equal to 0 or become lowest can be set as a reset voltage matching a corresponding driving voltage VDD.

In addition, by changing a driving voltage of the display device 100 and repeatedly performing the processes described above, a reset voltage can be set per a driving voltage VDD corresponding to each driving frequency in the low-speed drive mode.

Thus, a reset voltage Vrst set according to a driving voltage VDD can be stored in the data driving circuit 130, e.g., using a lookup table.

In addition, the data driving circuit 130 outputs a reset voltage which has been changed according to a driving voltage VDD supplied to the display panel 110, and it is therefore possible to prevent a display of flickers even when a driving voltage VDD is changed in the low-speed drive mode, to maintain display quality of images, and to reduce power consumption.

Meanwhile, as described above, when the display device 100 is driven with a specific frequency, a reset voltage Vrst with respect to a driving voltage VDD can be set based on a flicker score in accordance with a difference in waveforms of luminance between the refresh interval and the holding interval, or the reset voltage Vrst can be set by comparing luminance representing in the low-speed drive mode with luminance representing in a normal drive mode.

Figure 11:
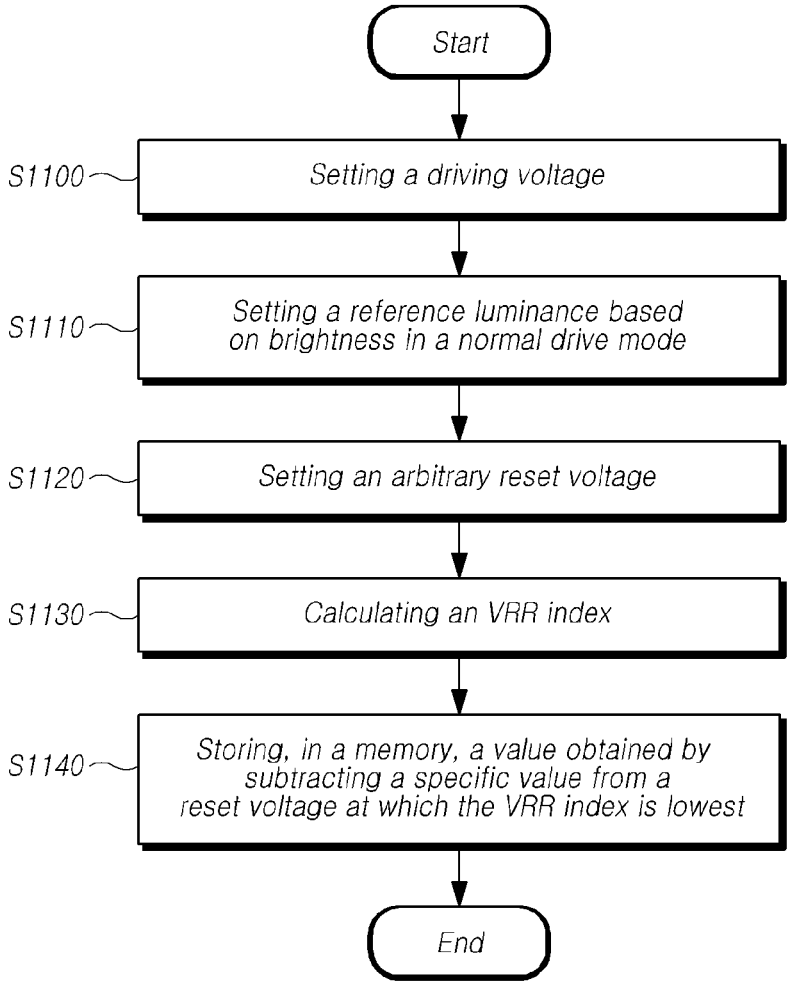
FIG. 11 illustrates a method of setting a reset voltage in accordance with a driving voltage of the display device according to embodiments of the present disclosure.

FIG. 11 illustrates a method of setting a reset voltage in accordance with a driving voltage of the display device according to embodiments of the present disclosure.

Referring to FIG. 11, in order to set a reset voltage Vrst in accordance with a driving voltage VDD in the low-speed drive mode, a level of the driving voltage supplied to the display panel 110 is set, at step S1100.

In addition, reference luminance for obtaining a reset voltage is set by adjusting brightness of the display panel 110 in a state where the display device 100 is driven in the normal drive mode (e.g., 60 Hz), at step S1110.

In a state where the driving voltage VDD and the reference luminance in the normal drive mode are set, an arbitrary reset voltage Vrst is set at step S1120 and the display device 100 becomes driven in the low-speed drive mode.

Thereafter, while the display device is driven in the low-speed drive mode, luminance resulted from the supply of the arbitrary reset voltage Vrst is measured and the measured luminance is compared with the reference luminance in the normal drive mode. In addition, a variable refresh rate (VRR) index is calculated based on a difference between luminance in the low-speed drive mode and reference luminance in the normal drive mode, at step S1130.

Herein, the VRR index is an absolute value of a ratio between luminance representing in the normal drive mode and luminance representing in the low-speed drive mode. The closer the RR index is to zero, the less a difference in luminance between the normal drive mode and the low-speed drive mode is.

Accordingly, a VRR index in accordance with the supply of the arbitrary reset voltage Vrst is calculated, and a reset voltage Vrst at which the VRR index is calculated closest to 0 can be set as a reset voltage Vrst matching a corresponding driving voltage VDD.

Alternatively, a value obtained by subtracting a specific voltage from a reset voltage Vrst at which the VRR index is lowest is set as a reset voltage Vrst. and the set reset voltage Vrst can be stored in a lookup table at step S1140.

This is caused by a difference between the flicker score described with reference to FIG. 10 and the VRR index, the specific value can be a value designated as an arbitrary value through comparing the flicker score with the VRR index, for example, 0.1V.

For example, a value obtained by subtracting 0.1V from a reset voltage Vrst derived based on the VRR index can be set as a reset voltage Vrst matching a corresponding driving voltage VDD.

Figure 12:
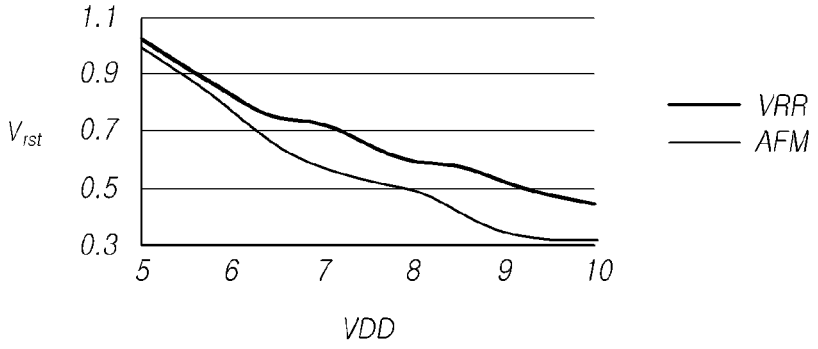
FIG. 12 is a graph showing a difference between a reset voltage in accordance with a flicker score shown in FIG. 10 and a reset voltage calculated by the method shown in FIG. 11.

FIG. 12 is a graph showing a difference between a reset voltage in accordance with a flicker score shown in FIG. 10 and a reset voltage calculated by the method shown in FIG. 12.

Referring to FIG. 12, the reset voltage Vrst in accordance with the flicker score tends to be lowered as a driving voltage VDD varies from 5V to 10V. It can be seen that an optimum reset voltage Vrst is inversely proportional to the driving voltage VDD in at least one section.

In addition, it can be seen that the reset voltage Vrst calculated using a VRR index also tends to be lowered as the driving voltage VDD increases.

Here, since there occurs a difference between the reset voltage Vrst based on the flicker score and the reset voltage Vrst based on the VRR index, a value obtained by subtracting a specific value from the reset voltage Vrst calculated through the VRR index can be set as a reset voltage Vrst matching each driving voltage VDD.

As the embodiments described above, a reset voltage Vrst set according to a driving voltage VDD can be set based on an index obtained by a difference in luminance between the refresh interval and the holding interval in the low-speed drive mode, a value obtained by a difference in luminance between the normal drive mode and the low-speed drive mode, or the like.

In addition to the embodiments described above, in order to not cause a flicker to be recognized or visible, it is possible to set a reset voltage Vrst for each driving voltage VDD using various methods of measuring luminance by changing the driving voltage VDD and the reset voltage Vrst.

For example, methods of setting a reset voltage Vrst matching a driving voltage VDD according to embodiments of the present disclosure are not limited to a specific method.

In accordance with embodiments of the present disclosure, when the driving voltage VDD is changed in the low-speed drive mode after a reset voltage Vrst matching a driving voltage VDD has been set, it is possible to overcome the flicker phenomenon by changing the reset voltage Vrst according to the changed driving voltage VDD, even when the driving voltage VDD is changed.

Figure 13:
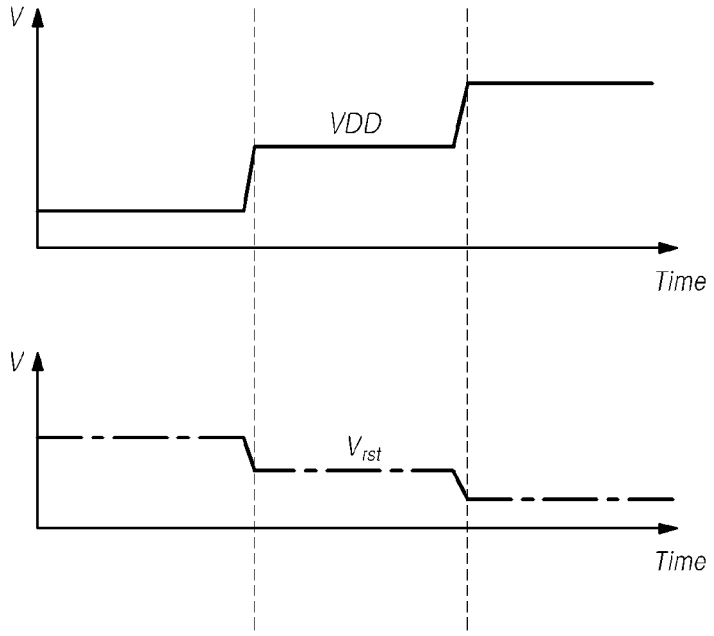
FIG. 13 is a plot showing a reset voltage in accordance with a driving voltage calculated by the method shown in FIG. 11.

FIG. 13 is a plot showing a reset voltage with respect to a driving voltage calculated by the method shown in FIG. 11.

Referring to FIG. 13, the reset voltage Vrst set in accordance with the driving voltage VDD can be stored in the data driving circuit 130, e.g., in a form of a lookup table.

The reset voltage Vrst can decrease as the driving voltage VDD increases.

For example, when a driving voltage VDD supplied to the display panel 110 is 5V, a reset voltage Vrst supplied in the holding interval in the low-speed drive mode can be 1V. When a driving voltage VDD supplied to the display panel 110 is 10V, a reset voltage Vrst supplied in the holding interval in the low-speed drive mode can be 0.46V.

The data driving circuit 130 can identify a reset voltage Vrst in accordance with a driving voltage VDD through the lookup table, and when the driving voltage is changed, change the reset voltage Vrst and output the changed reset voltage.

Here, the driving voltage VDD can be changed according to driving conditions or states (e.g., voltage unstableness, voltage drop, brightness control, external temperature, etc.) of the display device 100, and be controlled by the controller 140.

For example, the controller 140 can decrease a driving voltage VDD when a voltage supplied to the display panel 110 is unstable, and increase the driving voltage VDD when the voltage supplied to the display panel 110 is lowered. In addition, a driving voltage can be changed according to luminance of the display panel 110, i.e., a band.

Thus, when a driving voltage VDD is changed by the controlling of the controller 140, the data driving circuit 130 outputs a changed driving voltage VDD, and outputs a reset voltage matching the changed driving voltage Vrst.

In addition, the data driving circuit 130 can calculate, using an interpolation method, a reset voltage Vrst matching a driving voltage VDD which is not stored in the lookup table.

For example, when a driving voltage VDD is set to 7.5V, the data driving circuit 130 can output, as a reset voltage Vrst, 0.675V that is between 0.75V that is a reset voltage Vrst when the driving voltage VDD is 7V and 0.6V that is a reset voltage Vrst when the driving voltage VDD is 8V.

Thus, since the data driving circuit 130 can output a reset voltage matching a changed driving voltage VDD, it is possible to prevent occurrence of flickers in the low-speed drive mode even when a driving voltage is changed according to driving conditions or states etc. of the display device 100.

Figure 14:
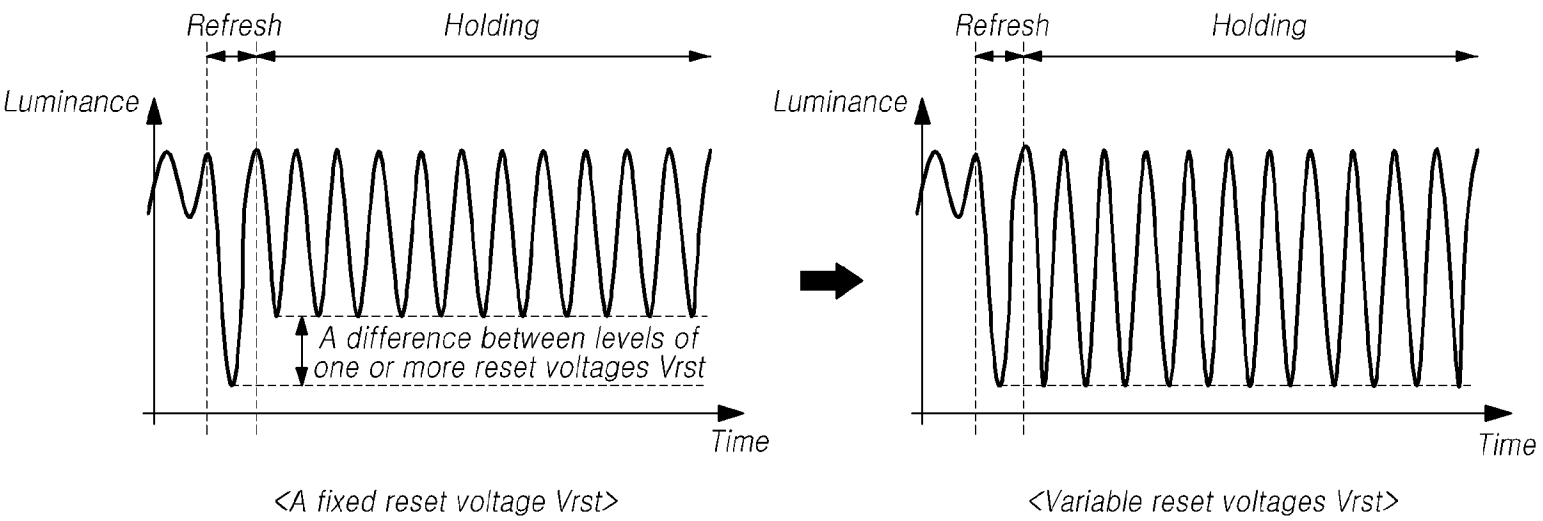
FIG. 14 is a plot showing a waveform of luminance measured in the low-speed drive mode when one or more reset voltages in accordance with a driving voltage is supplied as shown in FIG. 13.

FIG. 14 is a plot showing a waveform of luminance measured in the low-speed drive mode when a reset voltage in accordance with a driving voltage is supplied as shown in FIG. 13.

Referring to FIG. 14, since one or more reset voltages are periodically output in the holding interval in the low-speed drive mode, a waveform of luminance measured in the holding interval can be similar to that of the refresh interval.

Here, when one or more reset voltages Vrst are supplied with a fixed value, as a driving voltage VDD supplied to the display panel 110 varies, the lowest level of a waveform of luminance in the refresh interval can be different from the lowest level of a waveform of luminance in the holding interval.

On the other hand, when one or more reset voltages Vrst changed in accordance with one or more driving voltages VDD are supplied, since one or more reset voltages Vrst matching one or more driving voltages VDD supplied to the display panel 110 are supplied, the lowest level of a waveform of luminance in the refresh interval can be identical or substantially identical to the lowest level of a waveform of luminance in the holding interval.

For example, a reset voltage Vrst can be changed for matching a changed driving voltage VDD, and therefore, even when the driving voltage VDD is changed, the lowest level of a waveform of luminance in the refresh interval can be identical or substantially identical to the lowest level of a waveform of luminance in the holding interval.

In addition, since the lowest level of a waveform of luminance in the refresh interval is identical or substantially identical to the lowest level of a waveform of luminance in the holding interval, it is possible to prevent occurrence of flickers even when the driving voltage VDD supplied to the display panel 110 is changed.

Figure 15:
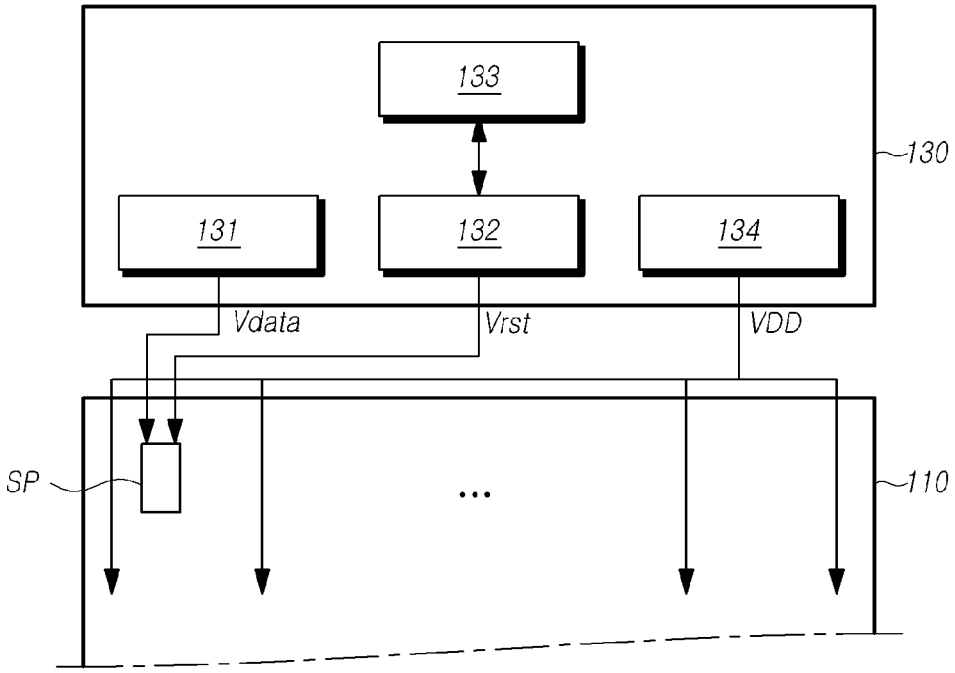
FIG. 15 is a block diagram illustrating a data driving circuit according to embodiments of the present disclosure.

FIG. 15 is a block diagram illustrating the data driving circuit according to embodiments of the present disclosure.

Referring to FIG. 15, the data driving circuit 130 can include a driving voltage output unit 131, a reset voltage output unit 132, a memory 133 and a driving voltage output unit 134.

The data voltage output unit 131 can output, to a subpixel SP, data voltages Vdata corresponding to image data received from a controller 140 in a refresh interval of one frame period.

The data voltage output unit 131 can output data voltages Vdata in each of the normal drive mode and the low-speed drive mode and in a driving method similar to each other.

The reset voltage output unit 132 outputs one or more reset voltages to the subpixel SP in a holding interval of a period in which the display device 100 is driven in the low-speed drive mode.

Such a reset voltage output unit 132 dose not output a reset voltage Vrst in a period in which the display device 100 is driven in the normal drive mode, but outputs one or more reset voltages Vrst in only a period in which the display device 100 is driven in the low-speed drive mode.

One or more reset voltages Vrst in accordance with driving conditions of display device 100 can be stored in the memory 133. For example, one or more reset voltages Vrst in accordance with one or more driving voltages supplied to the display panel 1100 can be stored in the memory 133.

The driving voltage output unit 134 can supply a driving voltage VDD to the display panel 110. The driving voltage output unit 134 can change the driving voltage VDD by controlling of the controller 140, and output the changed driving voltage.

When the driving voltage VDD output by the driving voltage output unit 134 is changed, the reset voltage output unit 132 can change a corresponding reset voltage to be supplied to the subpixel SP to a reset voltage Vrst matching the changed driving voltage VDD stored in the memory 133, and then output the changed reset voltage.

For example, since the reset voltage output unit 132 outputs an optimal reset voltage Vrst matching a changed driving voltage VDD, it is possible to overcome the flicker phenomenon through the supplying of the changed reset voltage even when a driving voltage VDD is changed in the low-speed drive mode.

Figure 16:
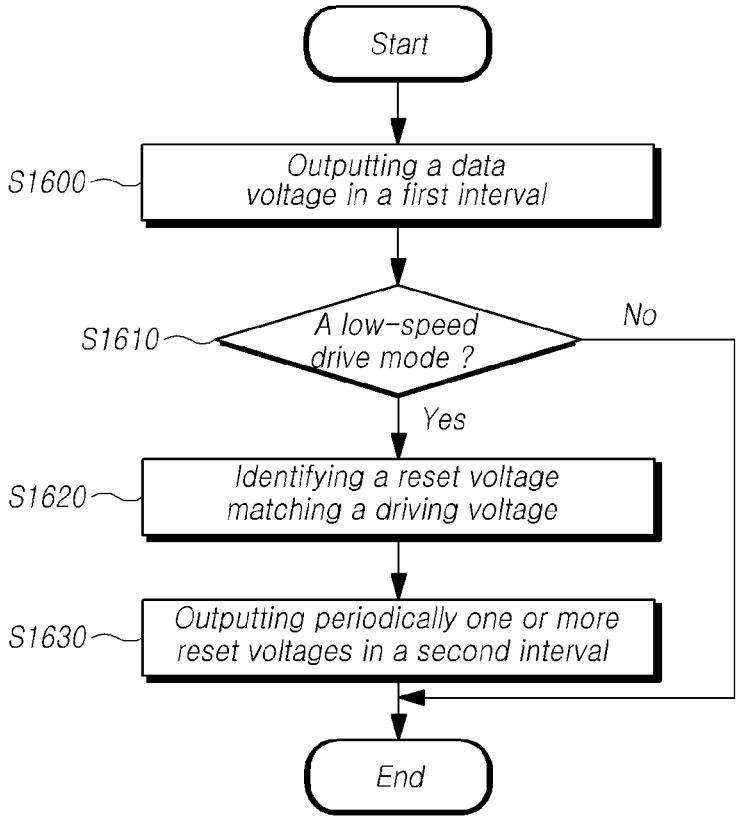
FIG. 16 is a flow chart illustrating a method of driving the data driving circuit according to embodiments of the present disclosure.

FIG. 16 is a flow chart illustrating a method of driving the data driving circuit according to embodiments of the present disclosure.

Referring to FIG. 16, the data driving circuit 130 outputs a data voltage Vdata in a first interval, e.g., a refresh interval, at step S1600.

In addition, when the display device 100 is driven in the low-speed drive mode, at step S1610, the data driving circuit 130 checks a reset voltage Vrst matching a driving voltage VDD supplied to the display panel 110, at step S1620.

The data driving circuit 130 periodically outputs one or more reset voltages Vrst that is set in accordance with one or more driving voltages VDD, at step S1630.

Thus, in accordance with embodiments of the present disclosure, since one or more reset voltages are periodically supplied in a holding interval of a period in which the display device 100 is driven in the low-speed drive mode, and an anode electrode of a light-emitting element is reset, a waveform of luminescence in the holding interval can be identical or similar to a waveform of luminescence in the refresh interval.

Accordingly, it is possible to prevent flickers from occurring or being recognized, which may be caused by a decrease in luminance in the holding interval or a difference in luminance between the holding interval and the refresh interval, in the low-speed drive mode.

In addition, when a driving voltage VDD supplied to the display panel 110 is changed, since a reset voltage that is set in accordance with a changed driving voltage VDD is supplied, it is possible to provide an optimal reset voltage Vrst matching each driving voltage VDD.

Though this, even when a driving voltage VDD is changed in the low-speed drive mode, it is possible to prevent occurrence of flickers on the screen, maintain display quality of images by changing a driving voltage VDD according to driving conditions, states etc. of display device 100, and reduce power consumption through low-speed driving.

Although a preferred embodiment of the present disclosure has been described for illustrative purposes, those skilled in the art will appreciate that various modifications, additions and substitutions are possible, without departing from the scope and spirit of the invention as disclosed in the accompanying claims. Although the exemplary embodiments have been described for illustrative purposes, a person skilled in the art will appreciate that various modifications and applications are possible without departing from the essential characteristics of the present disclosure. For example, the specific components of the exemplary embodiments can be variously modified. The various embodiments described above can be combined to provide further embodiments. These and other changes can be made to the embodiments in light of the above-detailed description. In general, in the following claims, the terms used should not be construed to limit the claims to the specific embodiments disclosed in the specification and the claims, but should be construed to include all possible embodiments along with the full scope of equivalents to which such claims are entitled. Accordingly, the claims are not limited by the disclosure.

What is claimed is:

1. A display device comprising:

a display panel including a plurality of gate lines, a plurality of data lines, and a plurality of subpixels;

a gate driving circuit configured to drive the plurality of gate lines; and a data driving circuit configured to drive the plurality of data lines, wherein each of the plurality of subpixels comprises:

a light-emitting element;

a driving transistor driving the light-emitting element, and including a first node electrically connected to a driving voltage line, a second node that is a gate node, and a third node electrically connected to the light-emitting element; and a scan transistor electrically connected between the third node and at least one of the plurality of data lines, wherein a data voltage is applied to the at least data line in a first interval, and a reset voltage is applied at least once to the at least data line in a second interval, of a frame period in a low-speed drive mode, and wherein when a first level of the driving voltage is applied to the driving voltage line, a first level of the reset voltage applied to the at least data line is different from a second level of the reset voltage applied to the at least one data line when a second level of the driving voltage different from the first level of the driving voltage is applied to the driving voltage line.

2. The display device according to claim 1, wherein a lowest level of a waveform of luminance of the display panel which is measured in the first interval is identical to a lowest level of a waveform of luminance of the display panel which is measured in the second interval.

3. The display device according to claim 1, wherein the first level of the reset voltage and the second level of the reset voltage are lower than a threshold voltage of the light-emitting element.

4. The display device according to claim 1, wherein the reset voltage is periodically applied in the second interval.

5. The display device according to claim 1, wherein the scan transistor is turned on in at least one sub-interval of an interval in which the reset voltage is applied in the second interval.

6. The display device according to claim 1, further comprising a first light-emitting transistor electrically connected between the third node and the light-emitting element, wherein the first light-emitting transistor is turned off in an interval in which the data voltage is applied in the first interval, and turned on in an interval in which the reset voltage is applied in the second interval.

7. The display device according to claim 1, further comprising a second light-emitting transistor electrically connected between the first node and the driving voltage line, wherein the second light-emitting transistor is turned off in an interval in which the reset voltage is applied in the second interval.

8. The display device according to claim 1, further comprising a compensation transistor electrically connected between the first node and the second node, wherein the compensation transistor is turned on in at least one sub-interval of an interval in which the data voltage is applied in the first interval, and turned off in an interval in which the reset voltage is applied in the second interval.

9. A display panel comprising:

a light-emitting element;

a driving transistor driving the light-emitting element, and including a first node electrically connected to a driving voltage line, a second node that is a gate node, and a third node electrically connected to the light-emitting element; and a scan transistor electrically connected between the third node and a data line, wherein a data voltage is applied to the data line in a first interval, and a reset voltage is applied at least once to the data line in a second interval, of a frame period in a low-speed drive mode, and wherein when a first level of the driving voltage is applied to the driving voltage line, a first level of the reset voltage applied to the data line is different from a second level of the reset voltage applied to the data line when a second level of the driving voltage different from the first level of the driving voltage is applied to the driving voltage line.

10. The display panel according to claim 9, wherein a lowest level of a waveform of luminance which is measured in the first interval is identical to a lowest level of a waveform of luminance which is measured in the second interval.

11. The display panel according to claim 9, wherein the scan transistor is turned on in at least one sub-interval of an interval in which the reset voltage is applied in the second interval.

12. The display panel according to claim 9, further comprising a first light-emitting transistor electrically connected between the third node and the light-emitting element, wherein the first light-emitting transistor is turned off in an interval in which the data voltage is applied in the first interval, and turned on in an interval in which the reset voltage is applied in the second interval.

13. The display panel according to claim 9, further comprising a second light-emitting transistor electrically connected between the first node and the driving voltage line, wherein the second light-emitting transistor is turned off in an interval in which the reset voltage is applied in the second interval.

14. The display panel according to claim 9, further comprising a compensation transistor electrically connected between the first node and the second node, wherein the compensation transistor is turned on in at least one sub-interval of an interval in which the data voltage is applied in the first interval, and turned off in an interval in which the reset voltage is applied in the second interval.

15. A data driving circuit comprising:

a driving voltage output unit configured to output a driving voltage to a driving voltage line;

a data voltage output unit configured to output a data voltage to a data line in a first interval of a frame period; and a reset voltage output unit configured to periodically output at least once a reset voltage to the data line in a second interval after the first interval of the frame period in a low-speed drive mode, wherein when the driving voltage output unit outputs a first level of the driving voltage to the driving voltage line, a level of the reset voltage which the reset voltage output unit outputs to the data line is different from a level of the reset voltage which the reset voltage output unit outputs to the data line when the driving voltage output unit outputs a second level of the driving voltage different from the first level of the driving voltage to the driving voltage line.

16. The data driving circuit according to claim 15, wherein the reset voltage output unit outputs the reset voltage once for each interval having a length identical to a length of the first interval during the second interval in the low-speed drive mode.

17. The data driving circuit according to claim 15, wherein a level of the reset voltage corresponding to the driving voltage is lowered in at least one sub-interval of an interval in which the driving voltage changes from a highest level to a lowest level.

* * * * *